United States Patent [19]

Di Edwardo

[11] Patent Number: 4,867,016

[45] Date of Patent: Sep. 19, 1989

[54] TOOL EXTENSION AND TORQUE TRANSFER DEVICE

[76] Inventor: William Di Edwardo, 1971 NE. 31st St., Pompano Beach, Fla. 33064

[21] Appl. No.: 199,855

[22] Filed: May 27, 1988

[51] Int. Cl.[4] ..... B25B 17/00

[52] U.S. Cl. ..... 81/57.3; 81/57.43

[58] Field of Search ..... 81/57.14, 57.3, 57.43

[56] References Cited

U.S. PATENT DOCUMENTS

| | | | |
|---|---|---|---|
| 2,466,456 | 4/1949 | Lybyer | 81/57.3 X |
| 3,138,983 | 6/1964 | Frizzell | 81/57.3 |
| 3,283,621 | 11/1966 | Faso | 81/57.3 |
| 3,714,852 | 2/1973 | Giangrasso | 81/57.3 |

*Primary Examiner*—James G. Smith

[57] ABSTRACT

The hand tool extension and torque transfer device for enabling effective transfer of torque to a bolt located in a difficult to access location. There is provided an elongated housing having a hand gripping portion, the gripping portion constituting about one third of the overall length thereof. Within the housing are provided sprocketed drive and driven elements which are connected by a chain encircling said drive and driven elements. The handle portion of the housing acts as a lever arm to overcome the static holding force of the bolt or nut to be loosened prior to application of a hand tool power element to the drive element of the hand tools extension device.

3 Claims, 4 Drawing Sheets

TOOL EXTENSION AND TORQUE TRANSFER DEVICE

BACKGROUND OF THE INVENTION

The present invention relates to handtools and, more particularly, to power transfer tools of the cain driven ratchet extension type.

Parallel drive chain driven ratchet wrenches, also known as socket wrenches, are known in the art as, more particularly, is exemplified by U.S. Pat. Nos. 2,672,065 (1954) to Danuskie; 2,678,577 (1954) to Tackett; 2,817,256 (1957) to Malone; 3,714,852 (1973) to Giangiasso; and 4,231,271 (1980) to Yamada.

The above, and other, prior art suffer from ertain limitations and inefficiencies in function which it is the intent of the present invention to remedy. More particularly, prior art wrenches of the above set forth parallel chain drive ratchet type do not provide to the user sufficient leverage or mechanical advantage to permit the usage of the tool in those situations requiring a high level of torque to break or loosen a particularl bolt or the like. Further, the chain drives of prior art devices of the above type are not provided with tensioning capability for the chain drive necessary to both enhance its durability and render the same particularly useful in high torque and high repetition rate applications.

It is as a response to the above set forth limitations in the prior art that the present invention is directed.

SUMMARY OF THE INVENTION

The present invention constitutes a ratched extension device having an elongate longitudinal housing, said housing including a handle portion and a chain drive portion, said handle portion comprising about one third of the longitudinal length of the housing, and said chain drive portion comprising about two thirds of the longitudinal length of said housing. A transition between the handle portion and the chain drive portion is defined by the presence a first sprocket gear which mates with a link chain. At the end of said housing, opposite to said handle portion, is provided a second sprocket gear which mates with an opposite end of said endless link chain. Each of said sprocket gears comprises an axially disposed female socket element proportional for the receipt of a male element of a ratchet wrench which, when inserted into said first sprocket gear, will transmit its torque through said link chain, to said second sprocket gear and, therefrom, through a male socket element to the element to be loosened by the inventive ratchet extension device. There is further provided a tensioning means located internally of said housing and adapted for advancement toward the center of said link chain in order to selectively increase the tension thereof to thereby compensate for slack of said chain developed in the course of usage of the inventive ratchet extension device.

It is, accordingly, an object of the present invention to provide a ratchet extension wrench of the endless chain, co-planar sprocket type that will provide to the user thereof a high torque mechanical advantage over a nut or bolt to be loosened or rotated.

It is another object to provide a ratchet extension to a ratchet wrench of the above type which does not make use of an external chain and which is provided with means for selective tensioning of the endless chain to thusly compensate for the effect on the chain of wear overtime.

It is a further object of the present invention to provide power transfer device for facilitating the transmission of mechanical torque in combination with the employment of the mechanical advantage of a lever means applied against the bolt or nut to be loosened.

The above and yet other objects and advantages of the present invention will become apparent in the hereinafter set forth Detailed Description of the Invention, the Drawings, and Claims appended herewith.

DETAILED DESCRIPTION OF THE INVENTION

Figure 1:
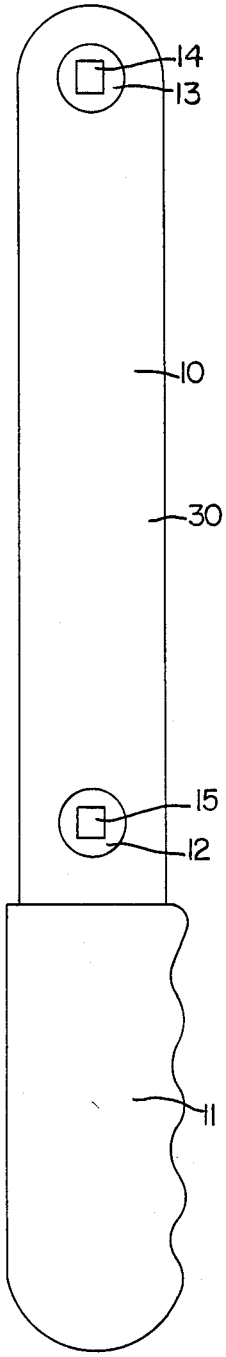
FIG. 1 is a front plan view of the inventive ratchet extension device in assembled form.
Figure 2:
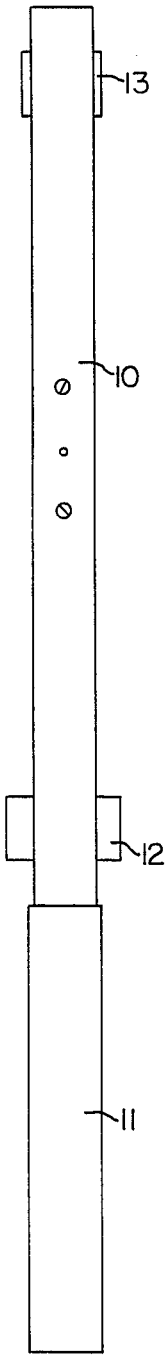
FIG. 2 is a side plan view thereof.

With reference to FIG. 1, the inventive ratchet extension device may be seen to include a housing 10, preferably made of steel having a hardened chrome external finish. The overall shape thereof is basically that of an elongated rectangle having a handle portion 11 and a chain drive portion 30. As may be noted in the front view of FIG. 1 and the side view of FIG. 2, the handle portion 11 is separated from the drive portion 30 by first sprocket gear 12 which has, centrally formed therein, a first female socket 15. As may be further noted from FIGS. 1 and 2, said first sprocket element 12 is positioned approximately one third from the handle end of the housing such that, resultingly, the ratio of the length of the chain drive portion 30 to the handle portion 11 of the ratchet extension device is approximately two to one. As will be further set forth below, driven sprocket gear 13, in addition to its other functions, serves as a point of rotation about which torque may be applied by the hands and arms of the user in order to increase the mechanical advantage occurring about its associated seconal female socket 14.

Figure 3:
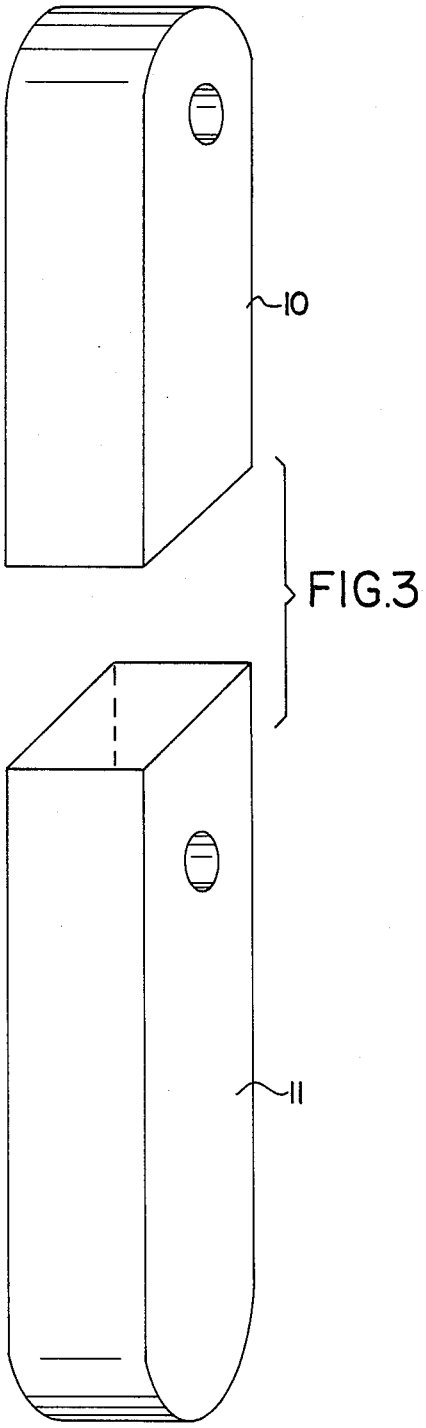
FIG. 3 is a perspective conceptual view of the construction of the housing of the inventive tool.

With reference to FIG. 3 there is shown a conceptual view of the housing 10 of the inventive ratchet extension device.

Figure 4:
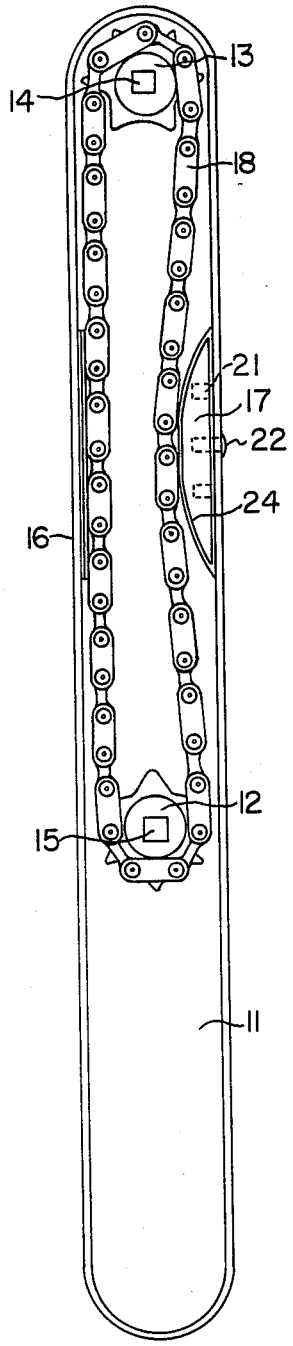
FIG. 4 is a front, breakaway view showing the internal relationship between the endless link chain, its coacting sprockets, and the tensioning means.
Figure 5:
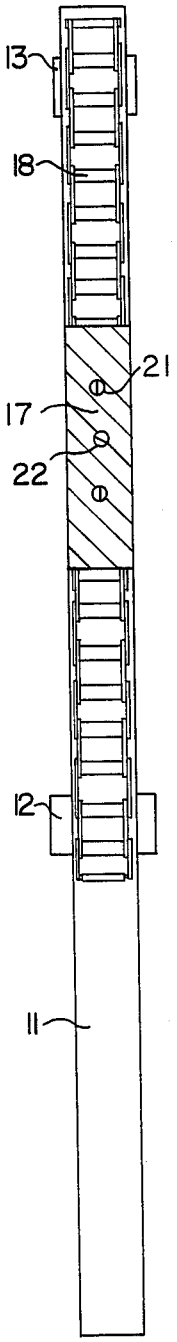
FIG. 5 is a side perspective view of the subject matter of FIG. 4.

With reference to the front and side break-away views of FIGS. 4 and 5 respectively, it may be seen that sprocket gears 12 and 13 mate with the links of link chain 18 such that torque which is applied to socket 15 will be transmitted through chain 18, to sprocket gear 13, to socket 14 and therefrom to the male bolt or the like which is to be loosened or uncoupled. As has been above noted, while torque is being inputed to socket 15 and the drive sprocket gear 12, handle 11 may be rotated by the user about second socket 14 to, thereby, add to the torque that is effectively applied to the bolt or nut to be unloosened. This feature has been found to be of considerable benefit in that it is frequently the case that the means for inputting torque to first socket element 15 of drive sprocket gear 12 is, for any one of a number of reasons, insufficient to transmit sufficient breaking torque to the nut or bolt to be loosened. In some instances, this is due simply to the awkwardness of making use of the input ratchet, as is commonly the case in a device of the type shown in U.S. Pat. No. 2,678,577 to Tackett, referenced above in the Background of the Invention. In other instances, the nut or bolt to be loosened will simply require more breaking torque than can be outputted from the input ratchet or that can be effectively transmitted through the chain link 18. Accordingly, the present invention enhances the amount of torque, both static and dynamic, which can be effectively applied to a given bolt or nut.

Figure 6:
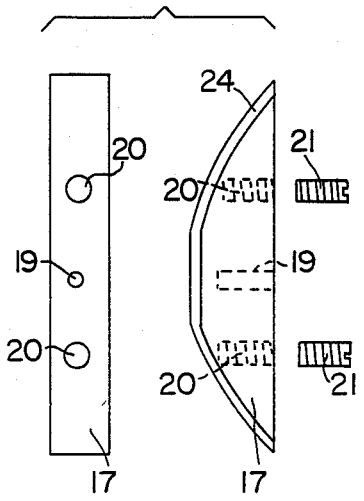
FIG. 6 is an enlarged side (at the left of the figure) and front view of the assembly shown in FIG. 4.
Figure 7:
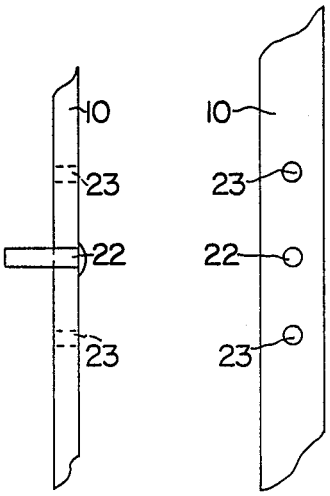
FIG. 7 is an enlarged fragmentary section of the housing of the ratchet extension in the area of the tensioning means.

Further shown in FIGS. 4 and 5 is a chain tensioning means 17 which includes a steel block having a curved surface (shown to the left in the view of FIG. 4) in which the opposite surface thereof is permanently secured to the wall of the housing 10 by a guide pin 22 which is set within a center drilled hole 19 (see also FIG. 6). The tensioning means itself is adjusted, in its transverse location relative chain 18, through the use of an adjuster stud 21 which, when advanced within threaded hole 20, causes the entire tensioning means 17 to advance into the direction of chain 18, thereby increasing the tension thereof.

Complementary to tensioning means 17 is a chain guide 16 (see FIG. 4) which consists of a high strength rubber-like material of the type employed in automobile camshaft chain guides. Said chain guide 16 is configured to have a width equal to that of the inside of housing 10 and is bonded to the interior sidewall of the housing. The purpose of said chain guide 16 is to keep chain 18 from contacting the inner wall of the housing, thereby preventing chain slap from occurring when the tool is in use. This feature is particularly important when high revolution usage of the inventive ratchet extension is being made as, for example, is the case when the ratchet extension use in connection with an air tool. It is to be appreicated, that unlike many prior art chain driven ratchet devices, the link chain thereof is entirely internal to the housing and, as such, is protected against possible impact, abrasion, or bending from externally involved elements employed by a user of the ratchet extension.

Figure 9:
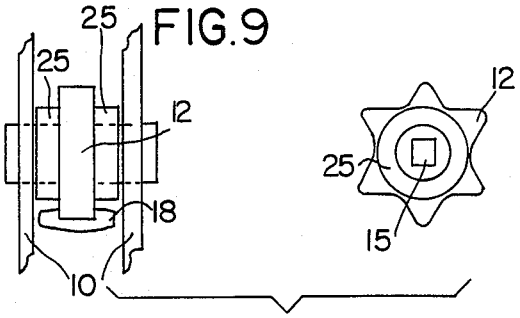
FIG. 9 is an enlarged side and front view of either sprocket and chain assembly showing, particularly, the relationship of the sprocket and link chain to the sidewalls of the housing.
Figure 8:
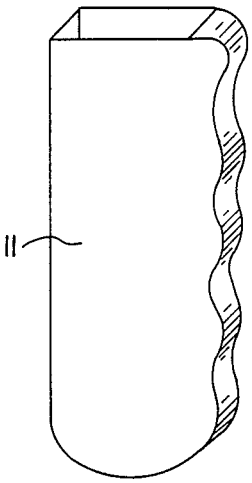
FIG. 8 is a perspective view of the rubber handgrip employed upon the handgrip portion of the external housing.

With reference to the view of FIG. 9, it may be noted that, upon either side of sprocket gear 12, are provided neoprene spacers 25 which function to maintain the proper spacing of sprocket gear 12 between the interior walls of the housing 10. Similarly neoprene spacers are provided with regard to sprocket gear 13.

It is to be appreciated that handle element 11 is of sufficient size to, when taken in combination with the length of driving portion 30 of the device, create a lever arm operating about the drive sprocket gear 13 of sufficient length to create a mechanical advantage capable of overcomeing the holding force of most bolts that would require loosening. Accordingly, a user of the present device can initiate the nut or bolt removal process by first "breaking" the nut or bolt to be loosened, using simply hand or arm force. Thereafter, a conventional ratchet wrench can be inserted into forst socket element 15 to complete the process of rotating the nut or bolt to be removed.

Figure 10:
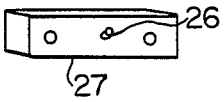
FIG. 10 is a perspective view of a double male element with two lock buttons.

With reference to FIG. 10, there is shown a male element 27 which, through the use of snap-lock elements 26, may be secured within second female socket 14 to thereby convert said element into a male element that may be coupled to a female element to be loosened.

It is to be understood that housing 10 constitutes a completely integral piece having, when assembled, no parts that are exposed to the air or external environment. This feature enables lubrication to be provided within the housing at the time of manufacture of the tool. Thereby the chain 18 will be provided with a continuous supply of lubrication that cannot be depleted, regardless of the environment within which it is used.

The above described internal lubrication feature as well as the above described tensioning feature comprise features not found in prior art tools of the present class.

Accordingly, while there has been shown and described the preferred embodiment of the present invention, it is to be appreciated that the invention may be embodied otherwise than is specifically shown herein with departing from the underlying idea or principles of this invention within the scope of the appended claims.

Having thus described my invention, what I claim as new, useful and non obvious and, accordingly, secure by Letters Patent of the Unites States is:

1. A hand tool extension and torque transfer device to enable an effective transfer of static and dynamic torque from a hand tool to a bolt, nut, or the like, located at an otherwise difficult to access location, said device comprising:

(a) an elongate housing having a hand gripping portion at one end thereof, said gripping portion comprising about one third of the longitudinal dimension of said housing, said gripping portion having a first end and a second end, said first end being co-incident with said one end of said housing, said elongated housing further comprising an integral housing adapted to hold and contain lubricant for internal elements of the device;

(b) a sprocketed drive element journalled in said housing at about said secone end of said gripping portion of said elongated housing, said drive element including an axial polygonal opening to receive a power element of said hand tool;

(c) a sprocketed driven element journalled in said housing at an opposite end thereof, said driven element including an axial polygonal opening for installing of socket means for connecting to a bolt or nut to be loosened; and (d) drive connecting means comprising a chain encircling said sprocketed drive and driven elements, whereby, by employing said end gripping portion, static torque may be applied about the axis of rotation of said driven element using the longitudinal dimension of said housing as lever arm to thereby overcome the static holding force of the bolt or nut to be loosened, prior to application of said hand tool to said drive element of the present device.

2. The device is recited in claim 1, further comprising:

tensioning means located internally of said housing, between said drive and driven elements and normally in contact with both a sidewall of said housing and said chain, said tensioning means comprising externally accessible means for transversely advancing said tensioning means against the said chain to selectively increase the tension thereof, whereby the durability and effectiveness of said chain is thereby increased through the selective use of said tensioning means.

3. The device as recited in claim 2 further comprising:

guide and dampening means for said chain, said means located internally of said housing between said drive and driven elements, and transversely opposite in location of said tensioning means.

* * * * *